United States Patent [19]

Edwards

[11] 3,956,954

[45] May 18, 1976

[54] ROTARY PAPER CUTTING DEVICE

[75] Inventor: William J. Edwards, Oklahoma City, Okla.

[73] Assignee: Honeywell Information Systems, Inc., Waltham, Mass.

[22] Filed: Feb. 20, 1975

[21] Appl. No.: 551,577

Related U.S. Application Data

[62] Division of Ser. No. 447,703, March 4, 1974, abandoned.

[52] U.S. Cl. ..... 83/285; 83/324; 83/341; 83/349; 83/365

[51] Int. Cl.[2] ..... B26D 5/08; B26D 5/34

[58] Field of Search ..... 83/341, 349, 285, 286, 83/296, 294, 324, 365

[56] References Cited

UNITED STATES PATENTS

| | | | |
|---|---|---|---|
| 2,246,957 | 6/1941 | Shields | 83/341 |
| 2,432,497 | 12/1947 | Behrens | 83/324 X |
| 2,548,427 | 4/1951 | Fernbach | 83/296 |
| 2,599,430 | 6/1952 | Beuerman | 83/324 X |
| 2,805,715 | 9/1957 | Novick | 83/341 |
| 3,057,239 | 10/1962 | Teplitz | 83/285 X |
| 3,750,510 | 8/1973 | Gabriels | 83/341 X |
| 3,875,838 | 4/1975 | Reppert | 83/285 X |

*Primary Examiner*—Frank T. Yost
*Attorney, Agent, or Firm*—R. T. Reiling; N. Prasinos; W. F. White

[57] ABSTRACT

An improved apparatus for cutting a moving web of paper comprising a cutting blade mounted on a rotary shaft at an angle to the axis of the shaft and a stationary cutting bar cooperating with the cutting blade to cut the web into paper of predetermined lengths. The apparatus is particularly suitable for cutting paper into predetermined lengths at high speeds as it is discharged from the printing system of a high-speed computer.

2 Claims, 10 Drawing Figures

ROTARY PAPER CUTTING DEVICE

BACKGROUND OF THE INVENTION

This is a division of U.S. patent application Ser. No. 447,703, filed Mar. 4, 1974 and now abandoned.

The present invention pertains to an apparatus for cutting a moving web of paper and, in particular, a cutting apparatus for cutting paper into predetermined lengths at high rates as it is discharged from the printing system of a high-speed computer or reproduction machine.

Present devices for cutting a moving web of paper in high-speed computer printing devices often employ parallel, reciprocating cutting blades. These devices cut across the entire width of the paper in a single cutting stroke and generally require a stopping device upstream of the cutting blades to arrest the paper flow prior to the cutting operation to insure an accurate cut. This present method of cutting paper, however, is not entirely suitable for cutting paper as it is discharged from a high-speed printing device. For example, the printout from a high-speed printing device associated with a computer often travels at a speed of 15–60 inches per second. To produce a final paper size having a 3 inch length requires about 5–20 cutting cycles per second. At these speeds the paper in the prior art devices cannot be stopped, cut and started to produce paper having an accurate predetermined cut. Further, since the entire width of the paper is cut simultaneously, considerable force must be applied to the cutting blades during the cutting action. The same problem exists if the paper is cut by a rotary blade wherein the entire paper width is cut simultaneously. This force must be supplied by blades having a large mass or by powerful motors. Neither of these means for applying the necessary cutting force, however, is conducive to rapid yet accurate cutting rates.

SUMMARY OF THE INVENTION

It is an object of the invention to provide an apparatus to accurately cut a moving web of paper into predetermined lengths. It is another object of this invention to provide an apparatus to accurately cut a moving web of paper into predetermined lengths without the necessity of stopping the web prior to the start of the cutting operation.

It is a specific object of this invention to provide an apparatus to accurately cut a moving web of paper into predetermined lengths by a rotary cutting action.

Accordingly, the present invention relates to an apparatus for cutting a moving web of paper into predetermined lengths which includes a rotary shaft member and at least one cutting blade longitudinally affixed to the rotary shaft member at an angle to the axis of the shaft. The cutting edges of the cutting blade cooperate with a complementary positioned cutting member to provide point contact between the cutting blade and the cutting member whereby paper positioned between the cutting blades and the cutting member is severed. A suitable mode of force is provided for the rotation of the rotary shaft. Preferably, the shaft is rotated by a direct current motor which is braked, after the cutting operation is complete, by reversing the current to the motor to insure an accurate cut.

Preferably, a pair of cutting blades are affixed to the shaft at an angle to the axis of the shaft to provide a V-shaped cutting edge. This V-shaped configuration provides two contact points between the blades and the complementary cutting member during the actual cutting operation and insures a rapid accurate cut without the necessity of large motors to rotate the cutting blades. The cutting member is preferably a stationary edge provided by a rectangular or square bar.

Other objects and embodiments will become apparent by reference to the following detailed description of the present invention when read in light of the accompanying drawings

DETAILED DESCRIPTION OF THE INVENTION

Figure 1:
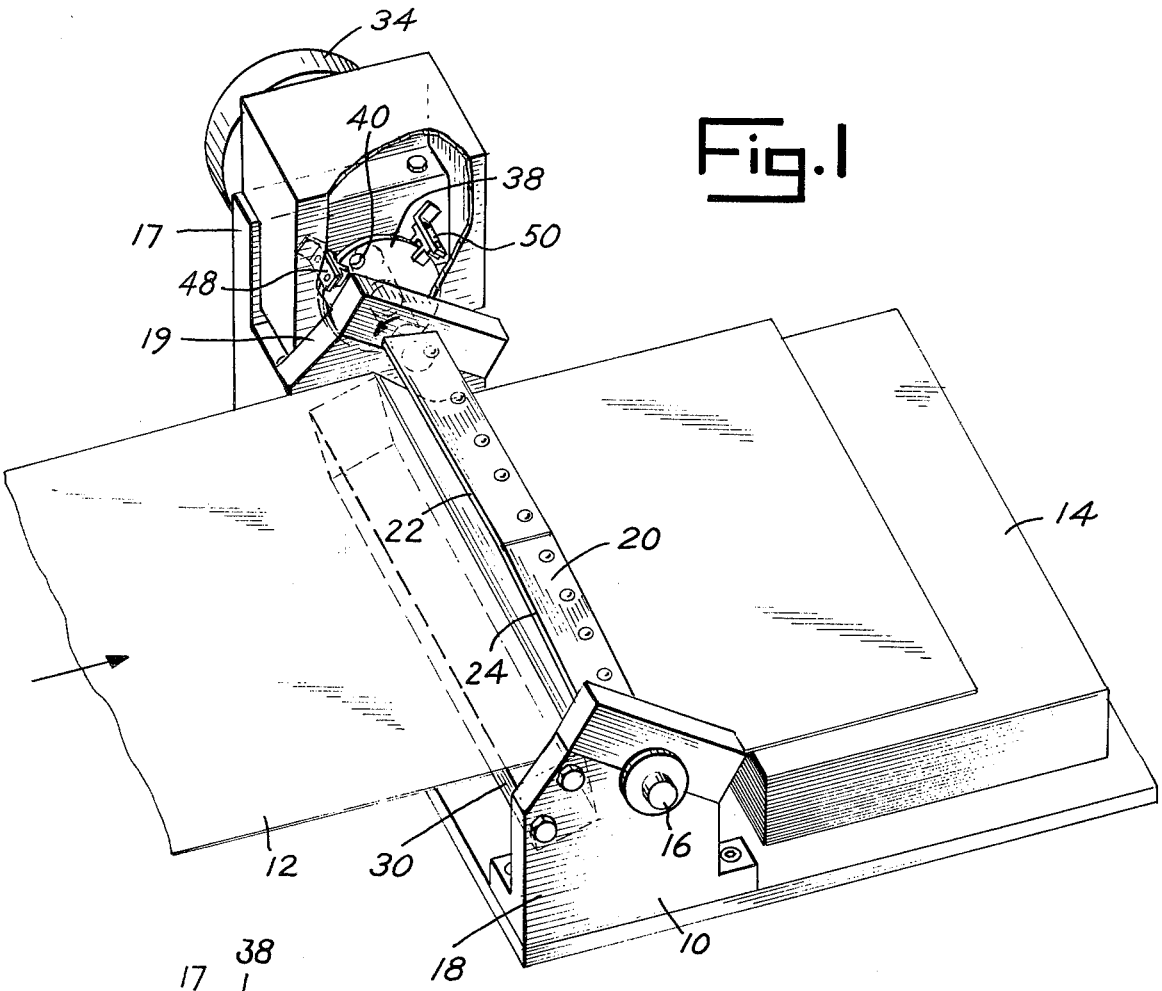
FIG. 1 is a perspective view of the cutting apparatus of the present invention.
Figure 2:
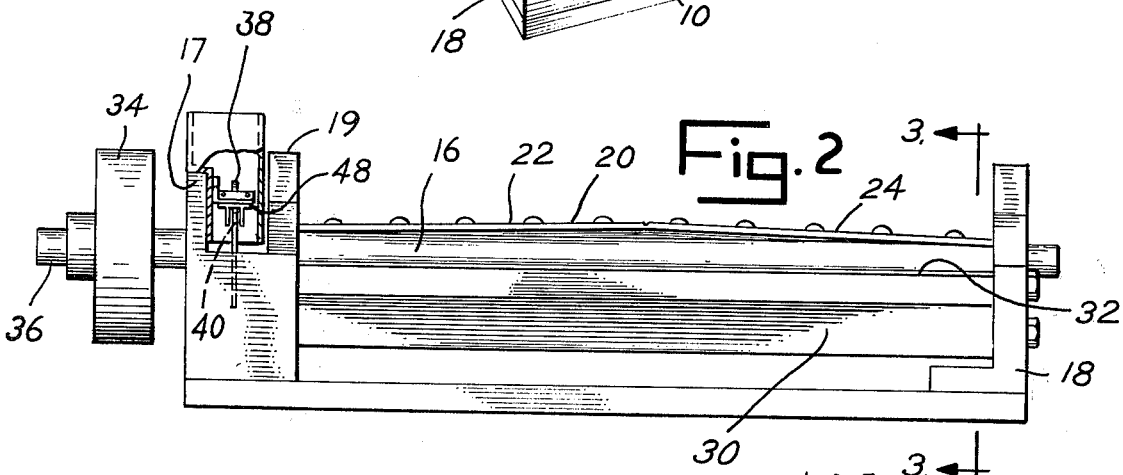
FIG. 2 is a front view of the apparatus illustrated in FIG. 1.
Figure 3:
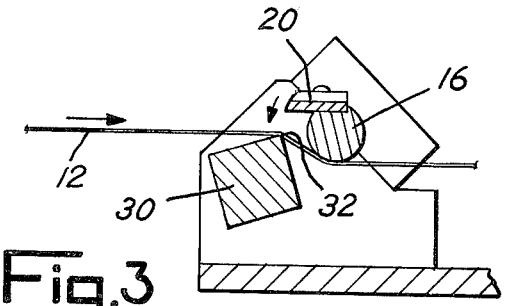
FIG. 3 is a cross-sectional view taken along section line 3—3 of FIG. 2 illustrating the position of the cutting member and the rotating cutting knife just prior to the cutting operation.
Figure 4:
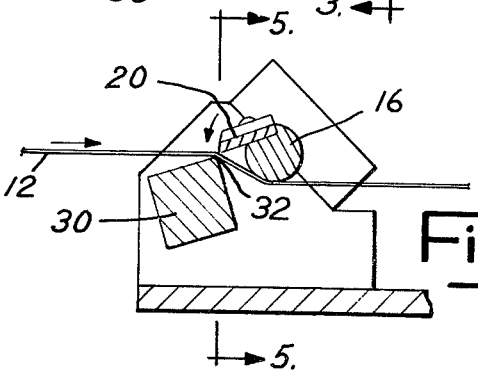
FIG. 4 illustrates the position of the cutting knife and the complementary cutting member at the instant the cutting operation starts.

Referring to FIGS. 1 and 2, there is illustrated a paper cutter 10 that is capable of accurately cutting paper sheets 14 of a predetermined size from a continuously moving paper web 12 as discharged from a high speed printer. This cutter comprises a rotary shaft 16 connected to the shaft 30 of suitable low inertia D.C. drive motor 34.

The velocity and timing of motor 34 is controlled through feedback signals from tachometer 36, timing disc 38, and a control circuit not illustrated, controlling the current to the motor. A cutting blade 20, with cutting edges 22 and 24 positioned at an angle to the axis of shaft 16, is affixed to shaft 16 to provide a V-shaped cutting edge. Preferably, each cutting edge has a slope of about ⅛ inch per 5–6 feet relative to the axis of the shaft. The cutting edges, however, must not be parallel to the shaft axis or drive motor 34 will not be able to cut paper web 12 unless motor 34 is a large motor. A sizeable motor, however, is not amenable to providing an accurate cut since it cannot be instantly started and stopped.

Figure 5:
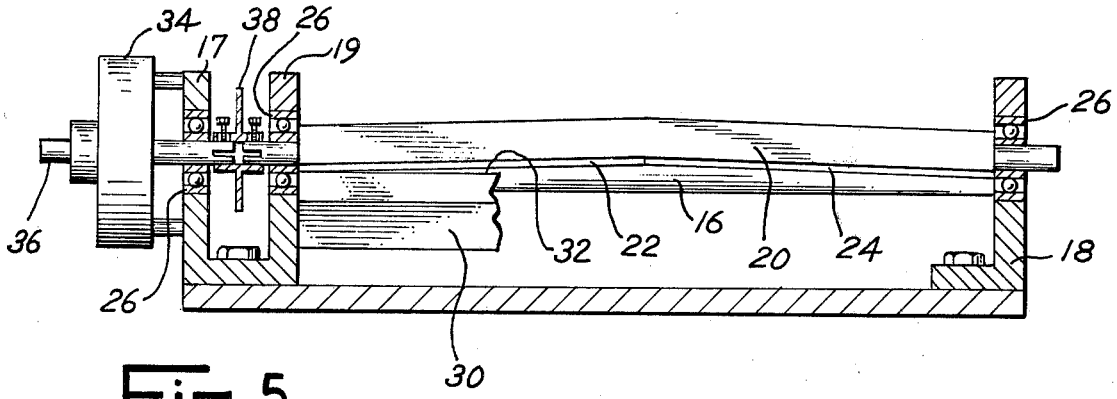
FIG. 5 is a front sectional view of the apparatus of the present invention taken along section line 5—5 of FIG. 4.
Figure 6:
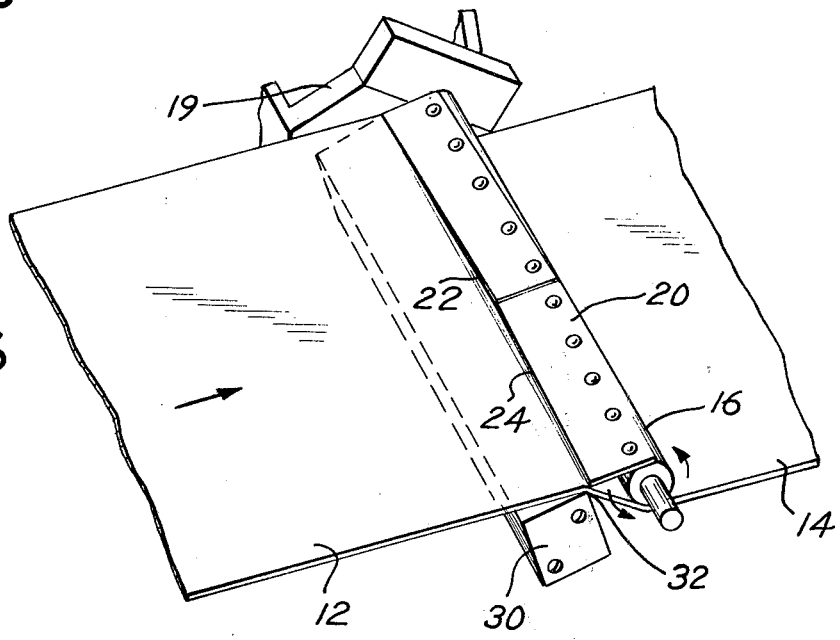
FIGS. 6 and 7 are perspective views illustrating various states of the cutting operation.
Figure 7:
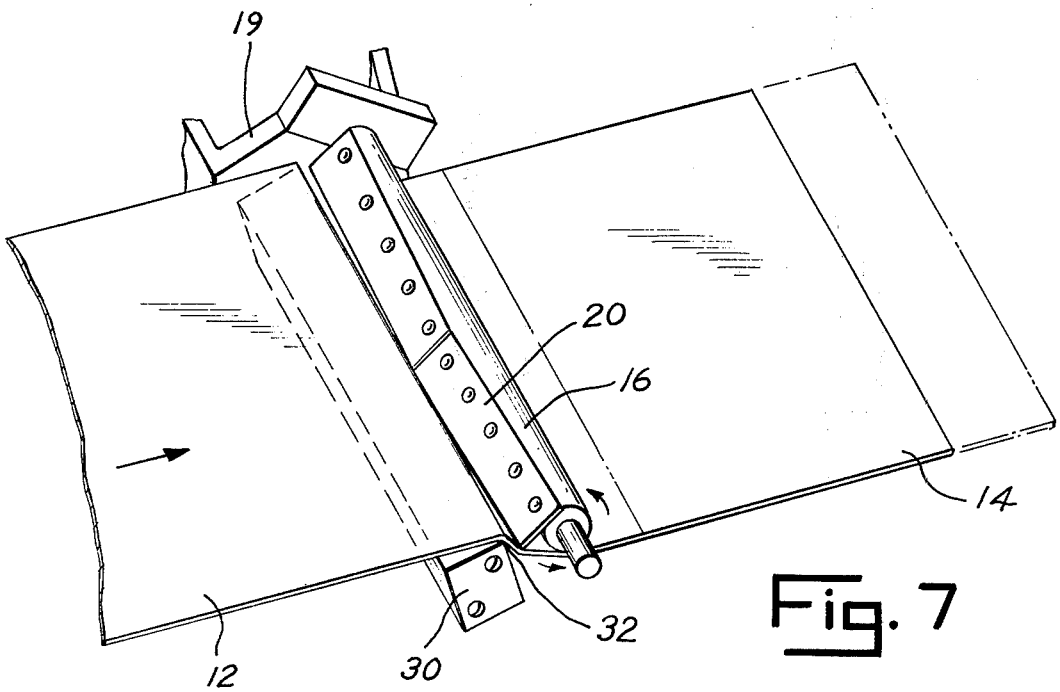
Figure 8:
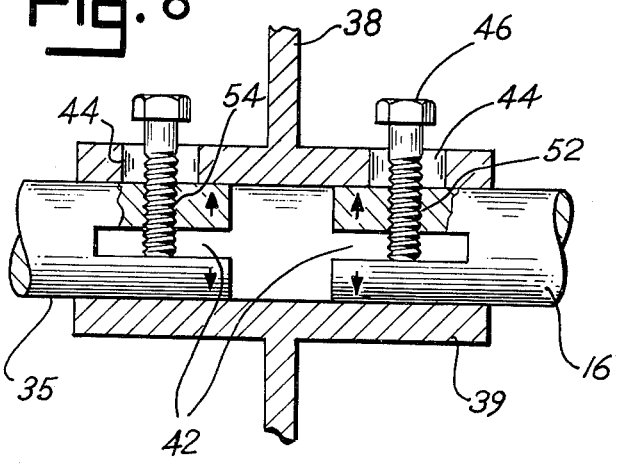
FIG. 8 is a detailed cross-sectional side view illustrating the interconnection of the motor shaft to the cutting blade shaft.

Referring to FIG. 5, shaft 16 is supported by bearings 26, which in turn are supported in suitable openings in support arms 17, 18 and 19 of the assembled unit. To provide an accurate cut, shaft 35 of motor 34 should be rigidly connected to shaft 16 of the cutter. As illustrated in detail in FIG. 8, the ends of shaft 16 and shaft 30 contain slots 42 which are snugly positioned within collar 39 of timing disc 38. A bolt 46 passes freely through unthreaded radial opening 44 in collar 39 and is threaded completely through threaded opening 52 in slot 42 of shaft 16. Similarly, a bolt 46 passes freely through unthreaded radial opening 44 in collar 39 and is threaded completely through threaded opening 54 and slot 42 in motor shaft 35. In each instance, the portions of shaft 16 and 30 opposite openings 44 are flat. Thus when bolt 46 is tightened the slotted portions of shafts 16 and 35 expand and a firm rigid connection is established between shafts 16 and 35 through collar 39 of timing disc 38.

Cutting edges 22 and 24 of blade 20 cooperate with edge 32 of cutting bar 30. In operation, when a sheet of paper is disposed between cutting edge 32 and blade 20 the paper is severed through the interaction of the blade and the cutting edge of the cutting bar. More particularly, the cutting operation starts at each edge of the paper and proceeds towards the middle of the cutting blade to complete the cutting operation.

Figure 9:
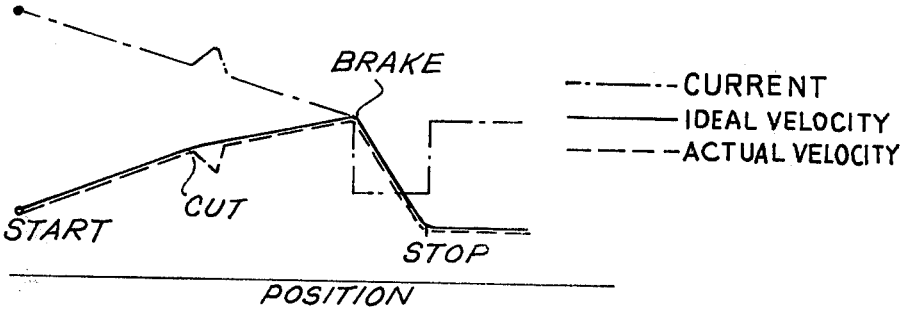
FIGS. 9 and 10 schematically illustrate the position of the cutting blade, blade velocity and motor current during various stages of the cutting operation.
Figure 10:
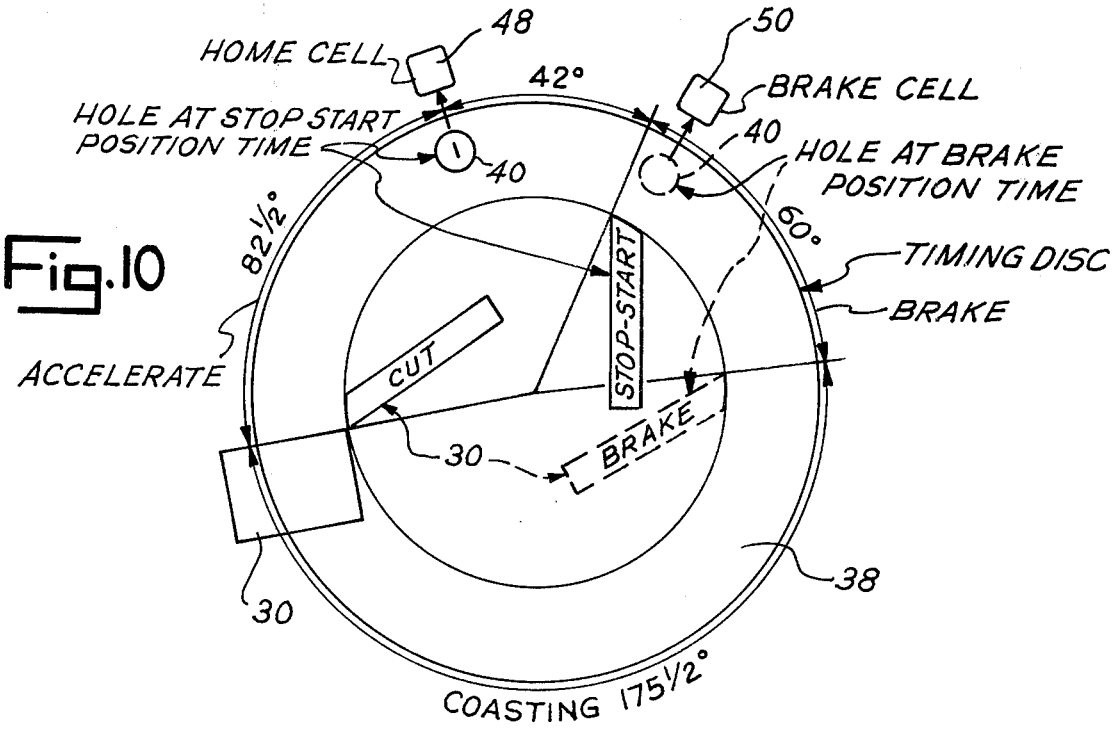

In an actual cutting cycle, and as illustrated in FIGS. 9 and 10, D.C. drive motor 34, an underated direct current motor, accelerates the cutting blade in response to hole 40 in timing disc 38 passing light sensor 48, causing the blade to cut through the paper web 12 while the paper is in contact with the cutting edge 32. When the blade passes through the paper and reaches a second predetermined position, light hole 40 in concentric timing disc 38 activates a light sensor 50. The light sensor in turn then transmits a signal to reverse the current flow of the direct current to the motor thereby braking the motor to zero velocity. The motor is then ready for acceleration for cutting another sheet of paper from the moving web.

Motor 34 is a low inertia motor and the torque required to accelerate, drive and stop the rotating blade is not high. For example, about 0.57 lb. ft. of torque is required to cut a sheet of paper. Further, the rotary cutting motion with the invention illustrated can effectively cut paper moving at 20 to 50 inches per second, by intermittent acceleration and deacceleration of motor 34, without the necessity of first stopping the paper. The pressure of the paper against blade 20 during the cutting operation does not interfere with the cut and a substantially straight cut is provided. However, when used to cut a rapidly moving sheet (30 inches/-sec.) the paper should be cut in less than 2 milliseconds to insure a substantially straight cut. Further, the present invention can go through up to 5 to 20 or more cutting cycles per second since the rotation of shaft 16 and hence the action of blade 20 is easily controlled by the proper manipulation of the direct current power to low inertia motor 34.

A typical cutting cycle is graphically illustrated in FIGS. 9 and 10, wherein D.C. motor 34 is programmed to follow the ideal velocity curve (solid line) illustrated in FIG. 9 as determined by a conventional control circuit (not shown) in response to feedback from tachometer 36. At the start of the cutting cycle a current of +12.5 amps is imposed upon motor 34 in response to hole 40 passing past detector 48 and the motor accelerates until the blade contacts and cuts the paper. During the time required for the cutting action, the acceleration of the blade is momentarily arrested and, in fact, the blade velocity is momentarily decreased (2milliseconds). The actual blade velocity is indicated by the dashed lines in FIG. 9. When hole 40 passes second detector 50, the current to motor 34 is reversed to a negative 15 volts thereby deaccelerating motor 34 and stopping the cutting blade. At the point in the cutting cyle where the current to motor 34 is reversed, the shaft has reached a rate of speed of about 1600 RPM. The current required by motor 34 is shown by the dot - dash lines in FIG. 9. The current required declines during acceleration due to the back EMF developed by the motor.

A side view of the cutting blade illustrated in FIG. 10 shows a preferred embodiment of the present invention having hole 40 positioned 42° in front of the cutting blade. The cutting blade is accelerated through 82½°, it coasts 175½° and it is braked to zero for 60°.

I claim:

1. A paper cutter apparatus for cutting a continuous moving web of paper into predetermined lengths which comprises:

a rotary shaft;

a rotary cutting blade longitudinally affixed on said rotary shaft at an angle to the axis of the shaft, said cutting blade including a pair of cutting edges providing a V-shaped cutting edge;

a complimentary stationary cutting blade, providing a cutting edge cooperating with said rotary cutting blade;

a motor having a motor shaft coupled to said rotary shaft for rotating the rotary cutting blade;

a timing disk mounted to said rotary shaft; and motor control means, responsive to said timing disk, for commanding an intermittent acceleration followed by an intermittent deceleration of said motor during each cut of the continuous moving web of paper thereby regulating the cutting cycle per second of said rotary shaft.

2. The apparatus as described in claim 1 which further includes:

a hole in said timing disk;

said motor control means including;

a first light detection means and a second light detection means positioned adjacent to said timing disk and operative in response to said hole passing by said detection means, said first light detection means adapted to initiate the start of the cutting operation and said second light detection means adapted to initiate the end of the cutting operation; and a tachometer mounted to said motor shaft for measuring the speed of the motor and cooperating with said first and second light detection means in controlling the acceleration and deceleration of said motor.

* * * * *